US007404730B2

(12) United States Patent
Kobayashi et al.

(10) Patent No.: US 7,404,730 B2
(45) Date of Patent: Jul. 29, 2008

(54) CONNECTOR, CONNECTOR ASSEMBLY AND A DETECTION TERMINAL

(75) Inventors: Yutaka Kobayashi, Yokkaichi (JP); Keiichi Nakamura, Yokkaichi (JP); Yutaka Noro, Yokkaichi (JP); Takahiro Kikuchi, Yokkaichi (JP); Yoshiyuki Ishikawa, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/904,450

(22) Filed: Sep. 27, 2007

(65) Prior Publication Data

US 2008/0081504 A1 Apr. 3, 2008

(30) Foreign Application Priority Data

Sep. 29, 2006 (JP) ..... 2006-266234

(51) Int. Cl.
*H01R 13/627* (2006.01)

(52) U.S. Cl. ..... 439/354

(58) Field of Classification Search ..... 439/488–489, 439/354, 188, 66, 490, 752, 862, 372, 352, 439/744, 595–596, 358, 357, 353
See application file for complete search history.

(56) References Cited

U.S. PATENT DOCUMENTS 5,174,776 A * 12/1992 Ohtaka et al. ..... 439/188
6,045,395 A 4/2000 Saito et al.
6,126,496 A * 10/2000 Shinozaki ..... 439/862
6,241,542 B1 * 6/2001 Nishide et al. ..... 439/188

* cited by examiner

*Primary Examiner*—Edwin A. León
(74) *Attorney, Agent, or Firm*—Gerald E Hespos; Anthony J. Casella

(57) ABSTRACT

A housing (10) has a lock arm (20) that pivots about a fulcrum (23) that is rearward of a pivoting portion (24) of the lock arm (20). A detection terminal (50) has a rear support (52) supported on the housing (10) rearward of the pivoting portion (24). An action portion (54) of the detection terminal (50) is engaged with the pivoting portion (24) and displaces with the pivoting portion (24). The lock arm (20) deforms during connection of the housing (10) and a mating housing (90) so that contacts (53) of the detection terminal (50) are not in contact with mating detection terminals (97). However, the lock arm (20) returns resiliently when the housings (10, 90) are connected properly so that the contacts (53) contact the mating detection terminals (97).

20 Claims, 8 Drawing Sheets

CONNECTOR, CONNECTOR ASSEMBLY AND A DETECTION TERMINAL

BACKGROUND OF THE INVENTION

1. Field of the Invention

The invention relates to a detection terminal, a connector and a connector assembly with a detection terminal.

2. Description of the Related Art

U.S. Pat. No. 6,045,395 discloses a connector with a housing and a mating housing that are connectable with one another. A detection terminal is inserted into the housing from behind and contacts a mating detection terminal in the mating housing when the housings are connected properly. A resiliently deformable lock arm is cantilevered backward from the front end of the housing, and has an end that is movable vertically relative to the front end.

The detection terminal is below the lock arm, and includes a support that is supported on a front inner wall of the housing. A main body extends obliquely up towards the back from the support. A rear part of the main body is angled to project up to define an action portion that can be pressed by the pivoting portion of the lock arm. A contact projects up in a middle part of the main body along forward and backward directions and can contact the mating detection terminal. The detection terminal includes a press-in portion formed by closely folding back a front end portion of the support so that the folded part extends horizontally. The press-in portion is pressed into the inner wall of an intermediate part of the housing to compensate for a shortage in the holding force of the support. On the other hand, the mating detection terminal is a pin that is long and narrow in forward and backward directions. A rib projects along the upper surface of the mating housing and extends along the mating detection terminal to prevent deformation of the mating detection terminal.

The lock arm moves onto a lock projection on the mating housing in the process of connecting the housing with the mating housing. Accordingly, the lock arm deforms and the action portion of the detection terminal contacts an operable portion and presses the operable portion down. Thus, the contact is held at a non-contact position distanced from the mating detection terminal. The lock arm returns resiliently to engage the lock projection when the housing is connected properly with the mating housing to lock the two housings together. Additionally, the action portion displaces up as the lock arm returns to bring the contact into contact with the mating detection terminal from below. Thus, a detection circuit is closed via the detection terminals and proper connection of the housings can be detected electrically.

The pivoting portion is at the rear end of the above-described lock arm and the action portion is displaced as the pivoting portion is deformed. As a result, the action portion and the contact must be considerably rearward from the front of the housing. The mating detection terminal must extend sufficiently forward to touch the contact. Hence, the mating detection terminal is longer than other signal terminals by the length of this extension, and the above-described rib is essential. As a result, the above-described connector cannot meet demands for miniaturization and costs are high.

The action portion is behind the contact. Thus, an amount of movement of the action portion in a detection process must be larger than that of the contact. Accordingly, the pivoting portion of the lock arm must be able to deform a large amount, thereby further complicating efforts to meet demands for miniaturization of the connector.

The support is at the front end of the detection terminal, and the contact must be farther from the front of the housing if the support is supported in a large area by the housing. This results in the extension of the mating detection terminal, and hence a very large supporting area can not be ensured. Therefore, the press-in portion and main body must be formed separately at opposite sides of the support by folding, which has caused a problem of complicating the structure of the detection terminal.

The invention was developed in view of the above problems, and objects thereof are to miniaturize a connector, to reduce cost and to simplify the structure of a detection terminal.

SUMMARY OF THE INVENTION

The invention relates to a connector with a housing that can be connected with a mating housing. The housing includes at least one lock arm with opposite front and rear ends. The lock arm is pivotal about a support rearward of the front end and a pivoting portion is defined near the front end of the lock arm. An accommodating portion is formed at the front of the housing for accommodating at least one detection terminal. The detection terminal has opposite front and rear ends. A support is defined near the rear end of the detection terminal and is configured to be supported at the accommodating portion of the housing. At least one action portion is defined forward of the support of the detection terminal and is configured to engage the pivoting portion of the lock arm. The detection terminal also has a contact to be brought into contact with a mating detection terminal on the mating housing. Displacement of the pivoting portion of the lock arm causes displacement of the action portion of the detection terminal. The pivoting portion of the lock arm pivots when the housing is connected partly with the mating housing. This pivoting movement of the pivoting portion of the lock arm causes the contact of the detection terminal to move to a position spaced from the mating detection terminal. The lock arm returns resiliently when the housings are connected properly and locks the properly connected housings together. The resilient return of the lock arm also causes the contact of the detection terminal to move into a position for contacting the mating detection terminal so that proper connection of the housings can be detected.

The lock arm preferably extends substantially in forward and backward directions of the housing.

The detection terminal also preferably extends substantially in forward and backward directions of the housing.

The pivoting portion is at the front part of the lock arm. The accommodating portion for the detection terminal is at the front of the housing and accommodates at least part of the support at the rear of the detection terminal. The action portion is formed at the front of the detection terminal and is displaceable with the pivoting portion of the lock arm so that the contact of the detection terminal can be brought into contact with the mating detection terminal. Thus, a contact position of the contact of the detection terminal and the mating detection terminal is at the front of the housing. Accordingly, the length of the mating detection terminal can be equal to the length of the other signal terminals. As a result, production cost can be reduced by using common terminals as the mating detection terminal and the other signal terminals, and the connector can be miniaturized by shortening the detection terminal.

The support of the detection terminal is at the rear of the detection terminal. The prior art terminal is supported at the front, and a large support at the front of the prior art terminal would require the contact of the prior art detection terminal to be spaced farther from the front of the housing. As a result, the above-described desirable effects of the detection terminal of the subject invention cannot be obtained. However, the support of the detection terminal of the subject invention is at the rear of the detection terminal, hence a large supporting area is provided between the rear of the detection terminal and the housing. Accordingly, it is not necessary to change the position of the contact from the front of the housing and a dead space in a rear part of the housing can be utilized. Thus, a degree of freedom in setting can be ensured. This eliminates the need to form a press-in portion folded back from the support in addition to the main portion, as in the prior art. Therefore, the structure of the detection terminal can be simplified.

The action portion and contact portion preferably are arranged to at least partly overlap with respect to forward and backward directions. Thus, the amount that the action portion is displaced by the pivoting portion and the amount that the contact is displaced as the action portion is moved are substantially equal. Accordingly, the action portion is not required to move more than the contact, which in turn reduces the amount that the pivoting portion is required to move. As a result, a pivoting range of the pivoting portion can be narrowed, enabling the miniaturization of the housing.

The detection terminal preferably includes a main portion whose plate surface extends substantially along forward and backward directions. The action portion projects at an angle, and preferably a substantially right angle from the main portion. The contact also projects at an angle, and preferably a substantially right from the main portion, but different from that of the action portion.

The contact preferably projects from one side of the main portion while the action portion projects from the opposite side of the main portion.

The action portion preferably is caught and engaged with the lifted-up pivoting portion and the bottom end of the contact is aligned substantially at the same height as adjacent signal terminals in the housing with the housing partly connected.

The detection terminal preferably has a main portion with a plate surface that extends along forward and backward directions. The action portion stands up from the main portion and the contact hangs down from the main portion. The action portion engages the lifted-up pivoting portion and the bottom end of the contact is at substantially the same height as adjacent signal terminals in the housing when the housing is partly connected.

The contact of the prior art detection terminal contacts the mating detection terminal from below, and it is necessary to ensure an accommodation space for the detection terminal in an area below the mating detection terminal in the mating housing. In contrast, the pivoting portion of the detection terminal of the subject invention is lifted up when the housings are connected partly. The action portion of the detection terminal of the subject invention engages the pivoting portion and the contact hangs down from the main portion. Thus, unlike the prior art, the contact engages the mating detection terminal from above, and the mating detection terminal can be at a lower height position. Further, the bottom end of the contact is at substantially the same height as the adjacent signal terminals in the housing, and hence the mating detection terminal also is at substantially the same height as the adjacent signal terminals. Thus, unlike the prior art, the mating detection terminal is not arranged above the other signal terminals. Accordingly, the mating detection terminal of the invention is protected by the surrounding signal terminals, and the rib or protection wall of the prior art is not necessary. Thus, production cost can be reduced further.

The contact of the prior art connector is retracted from the front of the housing. However, at least part of the contact of the subject invention preferably is exposed at the front of the housing. Thus, the height of the contact can be checked easily from the front of the housing and quality control costs can be suppressed.

The action portion of the detection terminal preferably includes a base-end area substantially continuous with the main portion and a mount area to be mounted on the pivoting portion. The mount area preferably is offset forward from the base end area and is at substantially the same position as the contact with respect to forward and backward directions.

The invention also relates to a connector assembly comprising the above described connector and a mating connector connectable therewith.

The invention further relates to a detection terminal for use with a connector assembly.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A connector according to a preferred embodiment of the invention is an airbag connector and has a housing identified by the numeral 10 in FIGS. 1-4, 6 and 7. The housing 10 is connectable with a mating housing 90. It should be noted that an end of the housing 10 that is to be connected with the mating housing 90 is referred to herein as the front end concerning forward and backward directions FBD.

Figure 2:
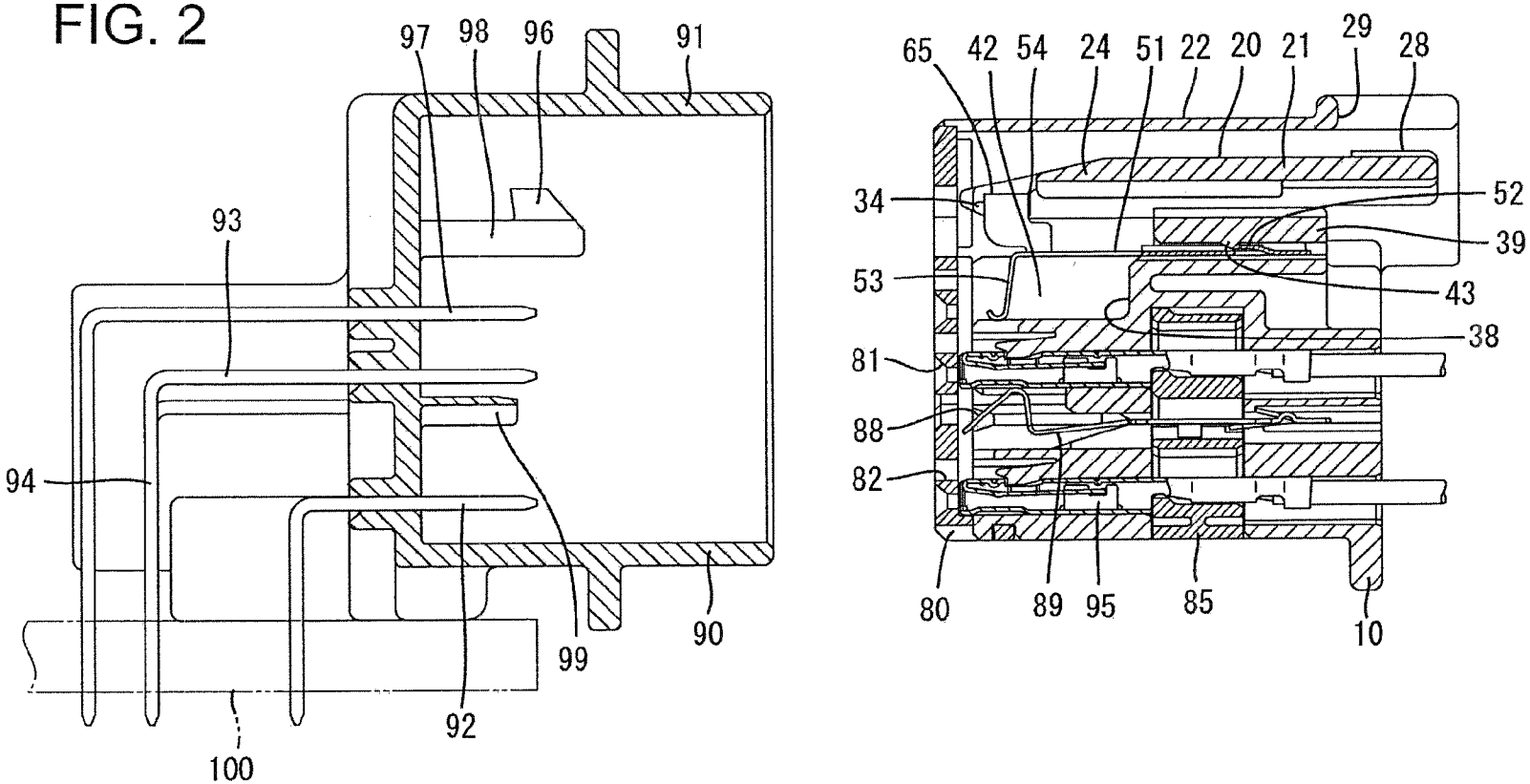
FIG. 2 is a side view in section showing a state before the connector is connected with the mating connector.

The mating housing 90 is made e.g. of a synthetic resin and includes a fitting tube 91 of substantially rectangular cross-section. Male terminal fittings 92 are mounted through the back wall of the fitting tube 91, as shown in FIG. 2. Each male terminal fitting 92 is bent into an L-shape, and includes horizontal and vertical sections 93 and 94 respectively. The horizontal sections 93 extend in substantially forward and backward directions FBD and leading ends of the horizontal sections 93 project into the fitting tube 91. The vertical sections 94 extend substantially perpendicularly down from the rear ends of the horizontal sections, and bottom ends of the vertical sections 94 are connected with conductor paths of a printed circuit board 100. The male terminal fittings 92 are arranged at three stages separated vertically in the height direction HD. Male detection terminals 97 are arranged between adjacent male terminal fittings 92 at upper stage. The male detection terminals 97 have substantially the same shape as the adjacent male terminal fittings 92 at the upper stage and are bent into L-shapes. The heights and front end positions of the male detection terminals 92 align substantially with the heights and front end positions of the adjacent male terminal fittings 92.

Two forwardly projecting locks 98 are arranged substantially side by side at positions above the male terminal fittings 92 and the male detection terminals 97 at the upper stage. The front ends of the locks 98 are located more forward than the front ends of the male terminal fittings 92 and the male detection terminals 97. A lock claw 96 projects up from the leading end of each lock 98. Further, two releasing pieces 99 project forward from the back wall of the fitting tube 91. The releasing pieces 99 are arranged substantially side by side between the male terminal fittings 92 at the lower stage and those at the middle stage.

The housing 10 is made e.g. of a synthetic resin, and is substantially in the form of a block. Cavities 11 are formed in the housing 10 and accommodate female terminal fittings 95 at positions substantially corresponding to the respective male terminal fittings 92. Each female terminal fitting 95 is partly locked and retained by a resiliently deformable lock 12 near the front end of the inner wall of the cavity 11. A wire 101 is connected to the rear end of each female terminal fitting 95 and is drawn to the outside through the rear of the housing 10.

Figure 3:
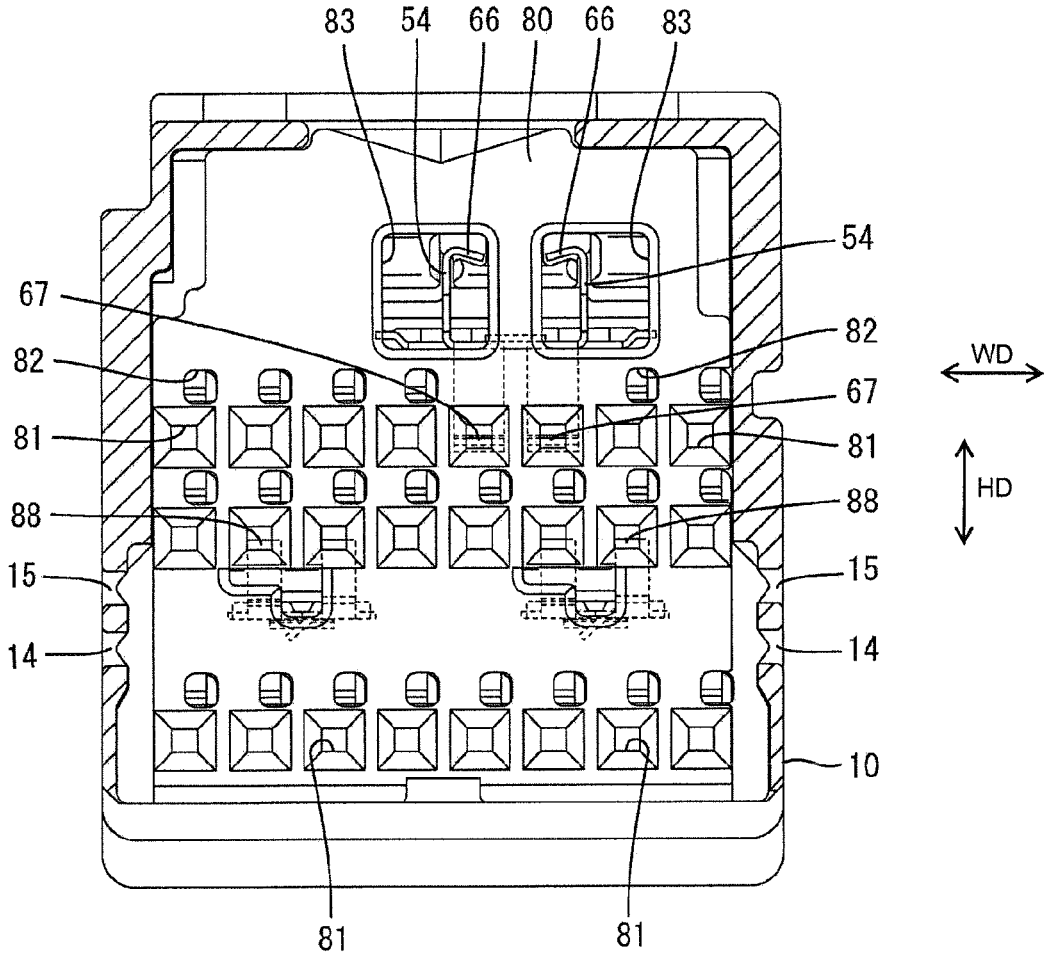
FIG. 3 is a front view partly in section of the connector.

The front of the housing 10 is covered by a front mask 80, as shown in FIG. 3. The front mask 80 is displaceable along the front surface of the housing 10 vertically in the height direction HD and substantially normal to connecting and separating directions CSD of the two housings 10, 90 between a partial locking position and a full locking position. An eave 13 projects forward from the upper edge of the housing 10 to the opposite side edges, and the front mask 80 is stopped by the eave 13 to be positioned at the full locking position. A partial engaging portion 14 and a full engaging portion 15 are formed one above the other in each of the opposite side edges of the front surface of the housing 10. The partial engaging portion 14 holds the front mask 80 at the partial locking position and the full engaging portion 15 holds the front mask 80 at the full locking position. The front mask 80 can be moved down to the partial locking position at the time of an electrical connection test and can be moved up to the full locking position when the connector is to be connected. The front mask 80 is formed with partial insertion openings 81 arrayed to enable the insertion of the respective mating male terminal fittings 92 and male detection terminals 97. Jig insertion openings 82 are formed at positions different from the insertion openings 81 to enable insertion of a jig for the electrical connection test. Further, two windows 83 are formed substantially side by side near an upper part of the front mask 80 for receiving the locks 98.

The housing 10 is formed with an insertion hole 16 that opens in the bottom surface and the opposite side surfaces of the housing 10. A side retainer 85 can be mounted into the insertion hole 16 from below and in a direction substantially normal to the connecting and separating directions CSD. The side retainer 85 is comb-shaped and is vertically displaceable between a partial locking position and a full locking position. The female terminal fittings 95 can be inserted and withdrawn when the side retainer 85 is at the partial locking position. However, the side retainer 85 achieves secondarily locking of the female terminal fittings 95 that have been inserted properly in the cavities 11 when the side retainer 85 is at the full locking position. Partial locks 17 and full locks 18 are formed one above the other at opposite side surfaces of the housing 10 at positions located slightly more inward than surrounding parts. The partial locks 17 are for partly locking the side retainer 85 and full locks 18 are for fully or doubly locking the side retainer 85

Accommodating portions 19 for the shorting terminals 89 are formed by recessing at the substantially opposite widthwise sides between the cavities 11 at the lower stage and those at the middle stage. Each shorting terminal 89 extends in forward and backward directions FBD. An intermediate part of each shorting terminal 89 penetrates through the side retainer 85, and a front side of each shorting terminal 89 is forked into contact pieces 88. Each shorting terminal 89 normally shorts at least the two adjacent female terminal fittings 95 by the resilient contact of the respective contact pieces 88 with the corresponding female terminal fittings 95 from below. The releasing pieces 99 of the mating housing 90 move between the respective contact pieces 88 and the corresponding female terminal fitting 95 as the two housings 10, 90 are connected, and push the contact pieces 88 down and away from the female terminal fitting 95 in a short-releasing direction to release the shorted state.

Figure 4:
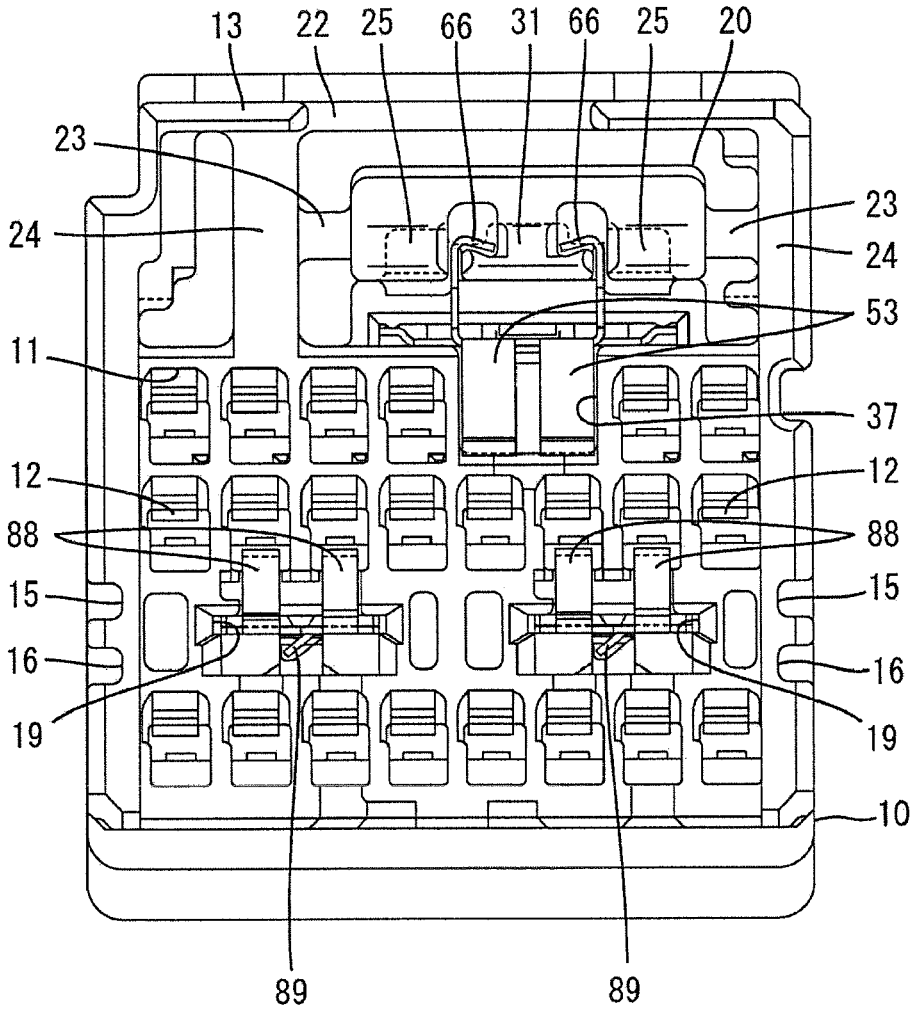
FIG. 4 is a front view of a connector housing having a detection terminal mounted therein.

The housing 10 is formed unitarily with a lock arm 20 that extends along the upper surface of the housing 10. The lock arm 20 includes a wide beam 21 that extends in forward and backward directions FBD and substantially parallel to the connecting and separating directions CSD of the two housings 10, 90. The beam 21 is covered by a cover 22 at the upper surface of the housing 10. The lock arm 20 is deviated towards the right side from the widthwise center of the housing 10, as shown in FIG. 4. Fulcrums 23 bulge out to left and right sides of the lock arm 20. The lateral edges of the beam 21 located slightly behind the centers of the lateral edges in forward and backward directions FBD, and the projecting ends of the fulcrums 23 are connected unitarily to the inner surfaces of supporting walls 24 that support the cover 22 from below. The lock arm 20 is capable of undergoing seesaw-like pivotal resilient displacements about the fulcrums 23, and an area of the beam 21 before the fulcrums 23 defines a pivoting portion 23 that is pivotal up and down in directions intersecting the connecting and separating directions CSD.

As shown in FIG. 4, left and right locks 25 are provided on the opposite widthwise sides of the front end of the pivoting portion 24. The locks 25 are in the form of claw-shaped projections that project laterally in and down. The rear surfaces of the locks 25 are substantially vertical lock surfaces 26. The lock surfaces 26 are opposed to the mating lock projections 98 in a withdrawing direction of the housing 10 for locking the two housings 10, 90 in a connected state. Further, the beam 21 is formed with lock grooves 27 extending in substantially forward and backward directions FBD behind the lock surfaces 26 of the locks 25. The lock grooves 27 are open at the rear end of the beam 21. The lock projections 98 are fit into the lock grooves 27 at the time of connecting the housings 10, 90. Further, an operable portion 28 is provided at the rear end of the beam 21. The operable portion 28 can be pressed to lift the front end of the pivoting portion 24 up in an unlocking direction like a seesaw to separate the locks 25 from the lock projections 98 when unlocking the lock arm 20. It should be noted that the rear end of the cover 22 is recessed at a position corresponding to the operable portion 28 to form a finger inserting portion 29.

Figure 5:
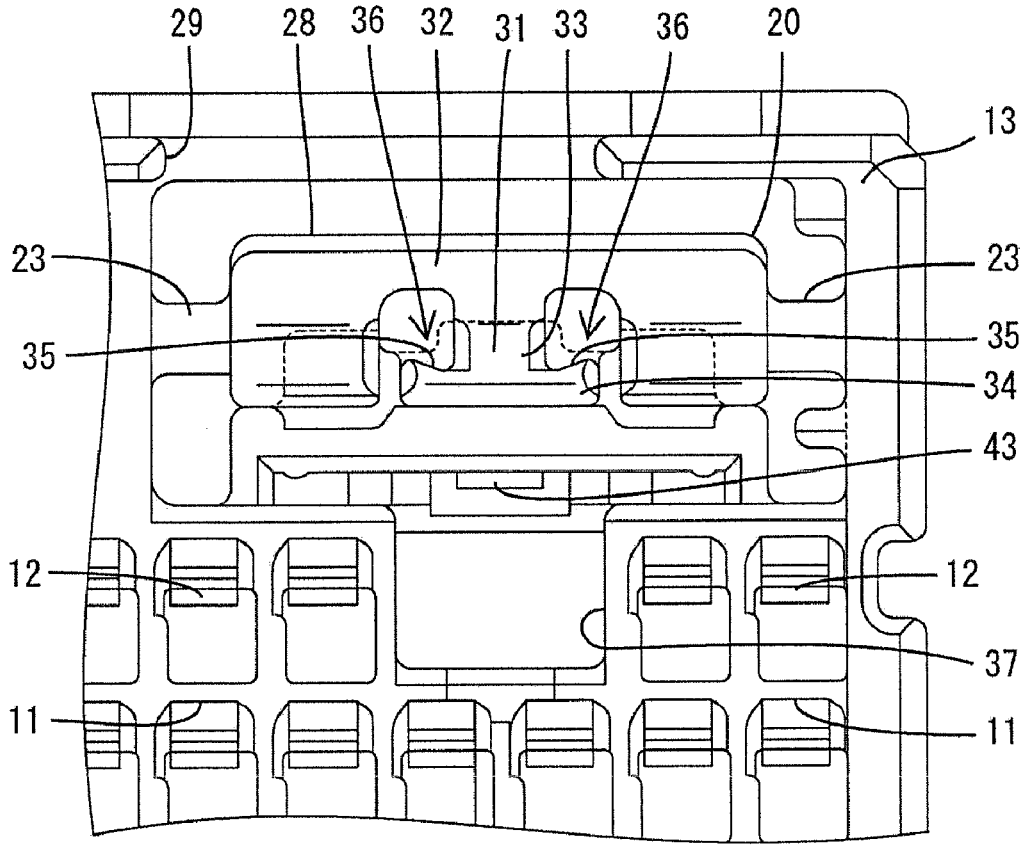
FIG. 5 is an enlarged front view of a lock arm and its surrounding members.

An engaging portion 31 projects forward in a widthwise intermediate position of the front end of the pivoting portion 24 for engaging the detection terminal 50. Locks 25 are arranged at the left and right sides of the engageable portion 31. The locks 25 and the engaging portion 31 are aligned at substantially the same positions in forward and backward directions FBD. As shown in FIG. 5, the engaging portion 31 is comprised of a beam 32 bridging the two locks 25 in a widthwise intermediate position of the upper end of the beam 21, a vertical shaft 33 extends down from the widthwise intermediate position of the beam 32 and a horizontal shaft 34 extends substantially horizontally from the bottom end of the vertical shaft 33 to define an inverted T-shape. The upper surface of the horizontal shaft 34 is inclined laterally and up in directions substantially away from the opposite side surfaces of the vertical shaft 33. These upward-inclined parts of the upper surface serve as catches 35 to be brought into catching engagement with the detection terminal 50. Loose spaces 36 are enclosed by the locks 25, the vertical shaft 33 and the horizontal shaft 34 for permitting displacements of the detection terminal 50 relative to the lock arm 20.

The front surface of the housing 10 is formed with an accommodating portion 37 for the detection terminal 50. The accommodating portion 37 is at a position deviated toward one lateral side from the widthwise center of the housing 10. Additionally, the accommodating portion 37 is juxtaposed with the cavities 11 at the upper stage and right below the lock arm 20. The accommodating portion 37 includes a connection space 38 and a mount space 41. The connection space 38 has a length from the front end of the housing 10 to a position slightly before the center of the housing 10 in forward and backward directions FBD and has a depth corresponding to the height of the cavities 11 at the upper stage. The mount space 41 is a wide slit that penetrates a step 39 behind the connection space 38 in forward and backward directions FBD. A substantially horizontal receiving surface 42 is defined at the bottom of the connection space 38 for supporting the leading ends of the male side detection terminals 97. A supportable portion 43 projects from the upper surface of the inner wall of the mounting space 41 (back wall of the accommodating portion 37) for locking the detection terminal 50. The rear surface of the supportable portion 43 is a substantially vertical locking surface and the front surface thereof is a slanted guiding surface for guiding the mounting of the detection terminal 50.

Figure 1:
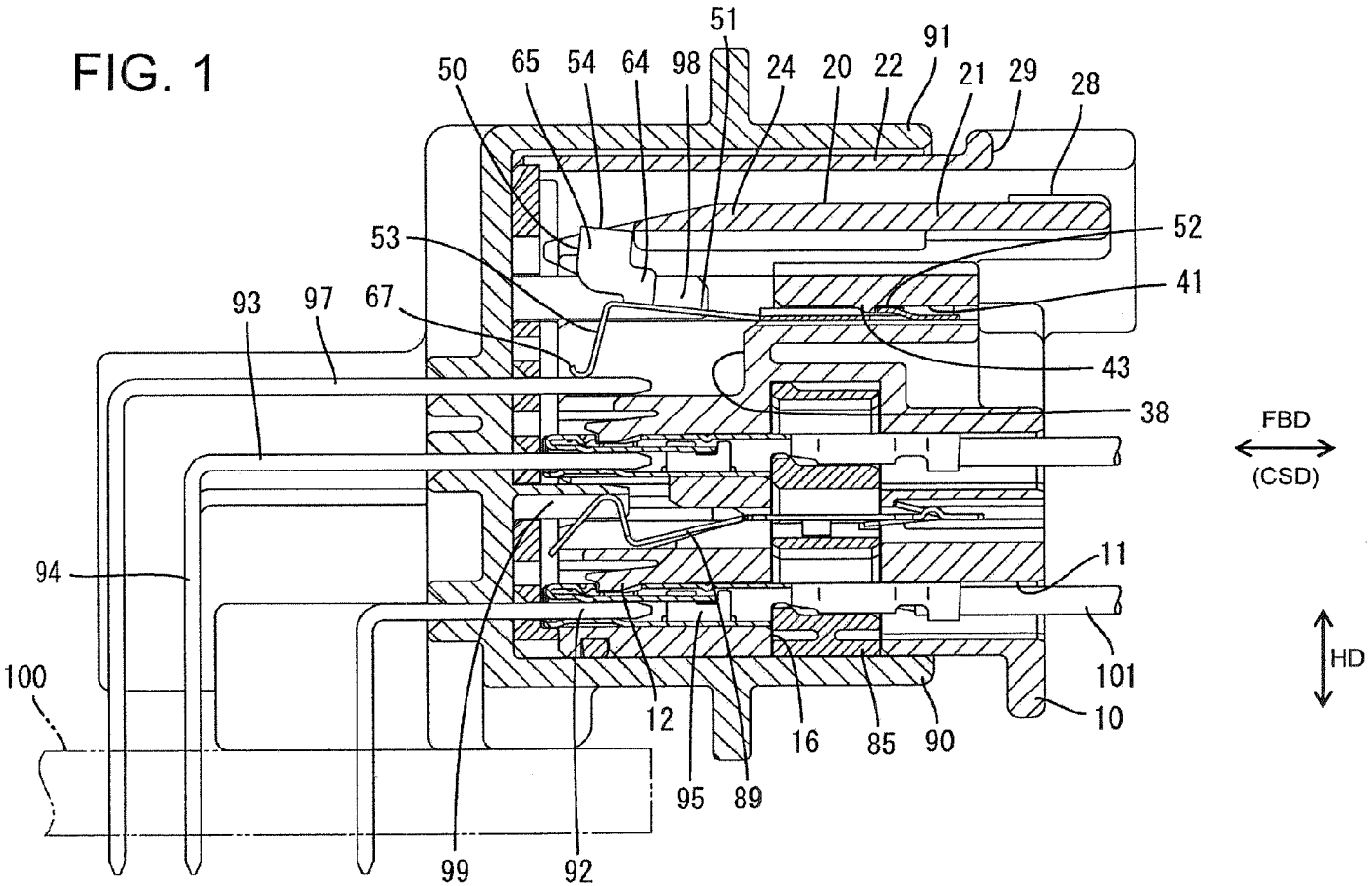
FIG. 1 is a side view in section showing a state where a connector of one embodiment is properly connected with a mating connector.
Figure 8:
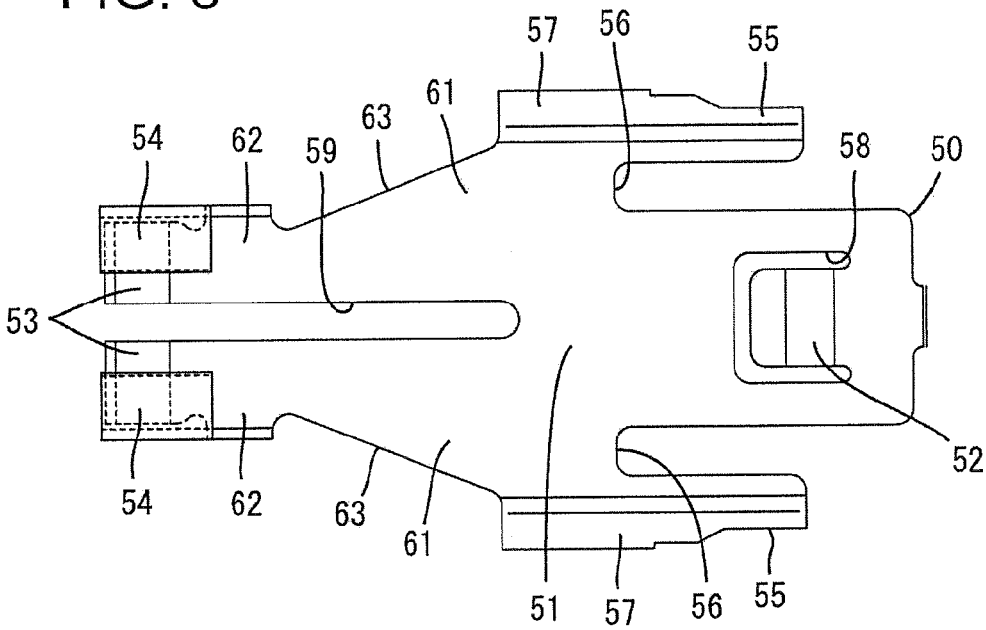
FIG. 8 is a plan view of the detection terminal.
Figure 9:
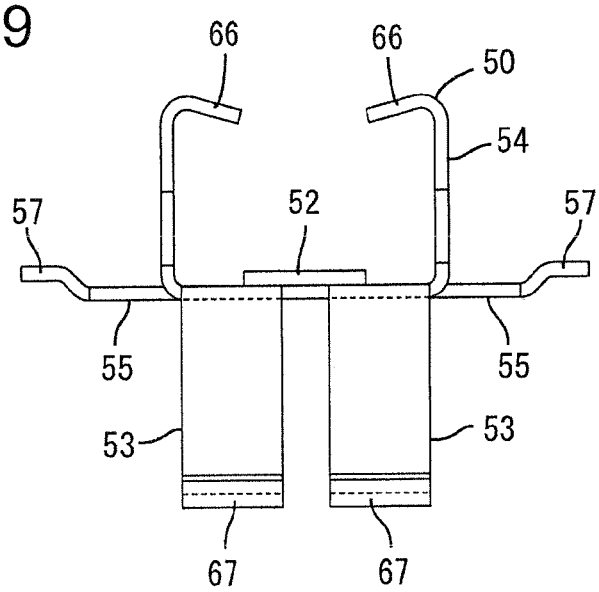
FIG. 9 is a front view of the detection terminal.

The detection terminal 50 is formed by bending an electrically conductive metal plate punched out into a specified shape. As shown in FIGS. 1, 8 and 9, the detection terminal 50 includes a main portion 51 with a plate surface that extends in forward and backward directions FBD. A support 52 is formed in the rear end of the main portion 51, whereas a contact 53 and an action portion 54 are provided at the front end of the main portion 51. Press-in portions 55 are provided at the opposite sides of the rear end of the main portion 51, and are transversely asymmetrically shaped with respect to a widthwise central axis.

The support 52 is formed by cutting a U-shaped slit in a widthwise center at a rear part of the main portion 51, and bending the area within the U-shaped slit obliquely up towards the front. The front end of the support 52 engages the supportable portion 43 of the housing 10 to restrict a forward movement of the detection terminal 50.

Figure 6:
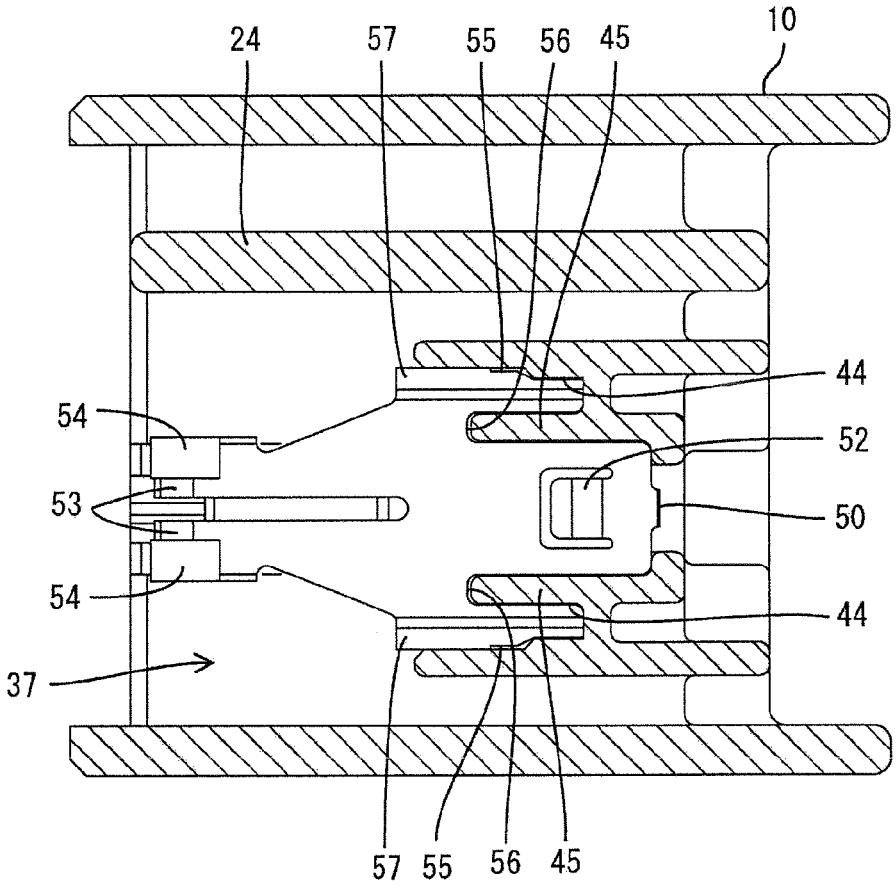
FIG. 6 is a horizontal section of the connector housing having the detection terminal mounted therein.
Figure 7:
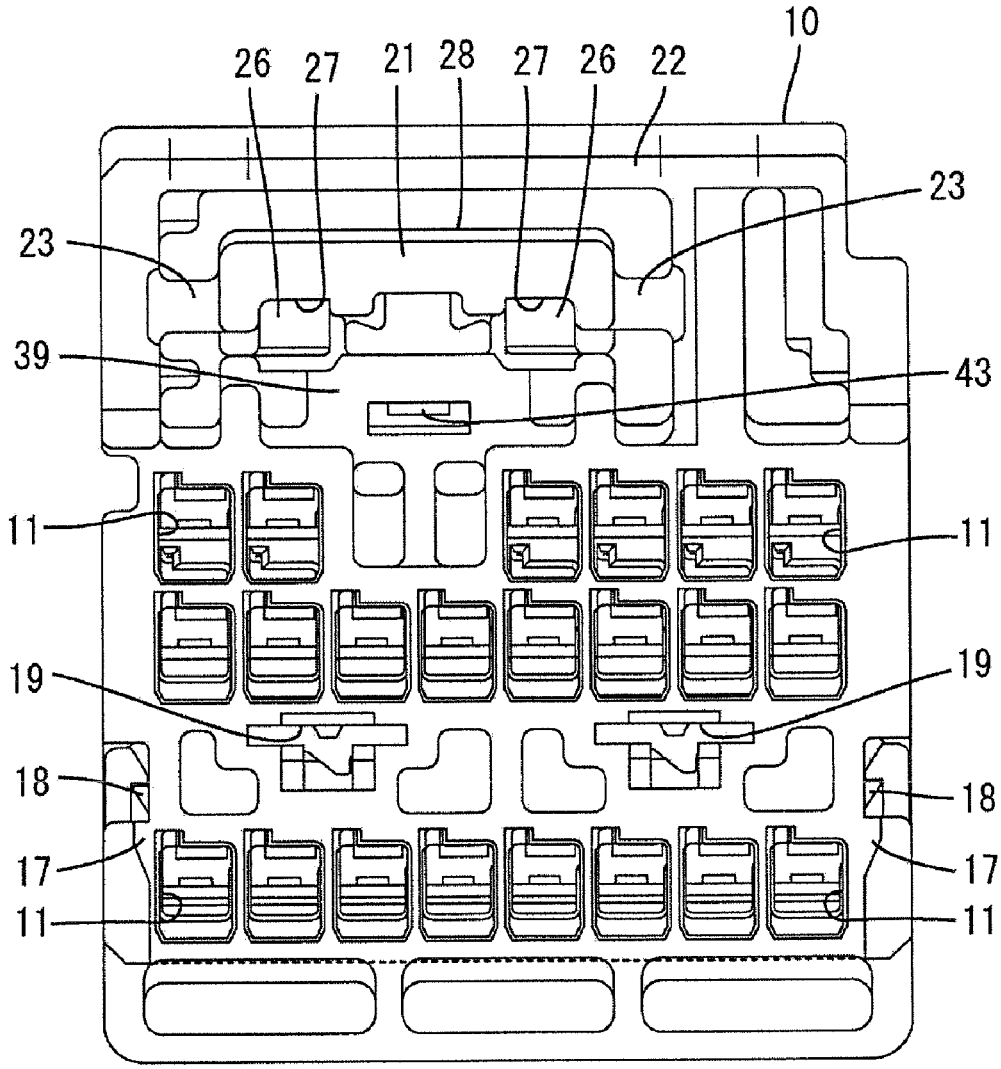
FIG. 7 is a rear view of the connector housing.

The press-in portions 55 are formed like wings at the opposite lateral edges of the main portion 51 before the support 52, and rearwardly open cut-in portions 56 are defined between the main portion 51 and the press-in portions 55. Each press-in portion 55 has a substantially horizontal stage 57 at a position slightly higher than the surface of the main portion 51. Each stage 57 is narrow and long in forward and backward directions FBD. Forwardly-open press-in spaces 44 are formed at opposite widthwise sides of the mount space 41 of the accommodating portion 37 and accommodate the press-in portions 55, as shown in FIG. 6. The outer edges of the stages 57 bite in the inner surfaces of the press-in spaces 44 when the press-in portions 55 are inserted into the press-in spaces 44 from the front, and partition walls 45 at the inner sides of the press-in spaces 44 in the housing 10 advance into the cut-in portions 56 from behind. Thus, the detection terminal 50 is prevented from moving backward.

A slit 59 extends back from a widthwise intermediate position of the front end of the main portion 51 and resilient pieces 61 are defined on opposite left and right sides of the slit 59. The rear end of the slit 59 is slightly behind the front ends of the press-in portions 55 in forward and backward directions FBD. The resilient pieces 61 have slanted outer side edges 63 gradually inclined toward the widthwise center as they extend forward from the connected parts with the press-in portions 55. Substantially rectangular supports 62 are formed at the front ends of the resilient pieces 61 and are narrower than the base ends of the resilient pieces 61. The action portions 54 and the contacts 53 are unitary with the supports 62.

Each action portion 54 has a base 64 standing up substantially perpendicularly along the outer side edges of the both supports 62. Each action portion 54, also has a mount panel 65 offset forward from the base 64 and engageable with the engaging portion 31 of the lock arm 20. Each action portion 54 further has a catch 66 bent in at an acute angle at the upper end of the mount panel 65. The catches 66 have an inclination to extend substantially along the catching surfaces 35 of the horizontal shaft 34 of the engaging portion 31. The action portions 54 follow the lifting movement of the pivoting portion 24 with the catches 66 caught by the horizontal shaft 34, so that the front end of the detection terminal 50 can be displaced resiliently.

The contacts 53 are strips that extend down from the front ends of the supports 62 and incline forward towards their bottom ends when viewed sideways. The bottom end of each contact 53 is formed into an arcuately bent contact body 67, and the outer surface of the bend of the contact body 67 can directly contact the mating male detection terminals 97. The contacts 53 and mount areas 65 overlap in forward and backward directions FBD. Specifically, the contacts 53 are accommodated substantially entirely within the ranges of the mount areas 65 in forward and backward directions FBD. The front surfaces of the contacts 53 and the front ends of the action portions 54 are at least partly exposed at the front surface of the housing 10 when the detection terminal 50 is mounted into the accommodating portion 37 of the housing 10. Further, as shown in FIG. 3, with the front mask 80 mounted on the front of the housing 10, the front ends of the action portions 54 can be seen through the windows 83 of the front mask 80 and the contact bodies 67 of the contacts 53 can be seen through the insertion openings 81 of the front mask 80 corresponding to the male detection terminals 97.

The front mask 80 is mounted at the full locking position on the front of the housing 10 and the side retainer 85 is inserted to the partial locking position in the insertion hole 16 of the housing 10. The shorting terminals 89 then are inserted into their accommodating portions 19 from the front, and the detection terminal 50 is inserted into its accommodating portion 37 from the front. The rear edge of the main portion 51 of the detection terminal 50 moves into the mount space 41 of the accommodating portion 37 as the detection terminal 50 is mounted. The outer side edges of the stages 57 of the press-in portions 55 are pressed into the inner surfaces of the press-in spaces 44 at a final stage of the mounting operation. At this time, the support 52 interferes with the supportable portion 43 and deforms down to extend substantially along the guiding surface of the supportable portion 43. The press-in portions 55 are fit closely in the mount spaces 41 when the mounting operation is completed to restrict a backward movement of the detection terminal 50. Additionally, the support 52 is restored resiliently and contacts the locking surface of the supportable portion 43 to restrict forward movement of the detection terminal 50. As a result, the detection terminal 50 is held at a proper mount position. The catching pieces 66 of the action portions 54 slide against the catching surfaces 35 of the horizontal shaft 34 as the detection terminal 50 is mounted properly. Additionally, the action portions 54 of the detection terminal 50 enter the loose spaces 36 of the lock arm 20 from the front, and the front side of the detection terminal 50 hangs down from the pivoting portion 24 of the lock arm 20. In this state, the contacts 53 of the detection terminal 50 lightly touch the receiving surfaces 42 of the connection space 38 in the accommodating portion 37, and the main portion 51 is held in a substantially horizontal posture.

The male terminal fittings 95 then are inserted into the cavities 11 of the housing 10 from behind and are locked by the locks 12. The side retainer 85 is moved to the full locking position after all of the female terminal fittings 95 are inserted for locking the female terminal fittings 95 redundantly. Infrared ray irradiation may be applied from the front to check whether the detection terminal 50 is mounted properly by confirming the heights of the contact portions 53.

Subsequently, the front ends of the housing 10 and mating housing 90 are positioned opposed to each other, as shown in FIG. 2, and the housing 10 then is fit into the fitting tube 91 of the mating housing 90. The locks 25 of the lock arm 20 move onto the lock claws 96 of the lock projections 98 during the connecting operation so that the pivoting portion 24 is lifted up. Lifting forces act on the catches 66 of the action portions 54 from the horizontal shaft 34 of the engaging portion 31. Thus, the action portions 54 follow the movement of the pivoting portion 24 and are lifted up with the press-in portions 55 of the main portion 51 as supports. The contact portions 53 also are lifted up as the action portions 54 move so that the contact main bodies 67 are separated from the receiving surfaces 42.

The male detection terminals 97 are inserted into the accommodating portion 37 for the detection terminal 50 through the insertion opening 81 of the front mask 80, and slide on the receiving surfaces 42 of the connection space 38. A lifted amount of the contact main bodies 67 in the height direction HD exceeds the thickness of the male detection terminals 97 and, hence, the male detection terminals 97 and contacts 53 do not contact each other in the process of connecting the two housings 10, 90. Further, the releasing pieces 99 push the contact pieces 88 of the shorting terminals 89 in the process of connecting the two housings 10, 90 and release the shorting terminals 89 from the shorting state. The pivoting portion 24 of the lock arm 20 returns to its original horizontal posture when the housing 10 is inserted to a proper depth into the fitting tube 91. As a result, the lock claws 96 enter the lock grooves 27 and face the locks 25 in the separating directions of the two housings 10, 90 to lock the housings 10, 90 in their connected state.

The detection terminal 50 returns with the pivoting portion 24 of the lock arm 20 when the housing 10 is connected properly. As a result, the contacts 53 contact the corresponding male terminal fittings 97 from above to close a loop of a detection circuit, thereby electrically detecting that the housings 10, 90 are locked in their properly connected state. In this state, the front end of the main portion 51 of the detection terminal 50 is deformed slightly, and the catches 66 of the action portions 54 enter a free state by moving from the horizontal shaft 36 to the loose communication portions 36.

The locks 25 remain on the lock claws 96 and the pivoting portion 24 remains lifted up, if the housing 10 is left partly connected. Then, the contacts 53 of the detection terminal 50 are spaced up from the male detection terminals 97, and the detection circuit is not closed. Thus, an operator can detect that the two housings 10, 90 are not connected properly.

The pivoting portion 24 is at the front end of the lock arm 20 and the accommodating portion 37 for the detection terminal 50 is at the front of the housing 10. Additionally, the support 52 is at the rear of the detection terminal 50 and the action portions 54 are at the front of the detection terminal 50. The action portions 54 follow the movement of the pivoting portion 24 and the contacts 53 for contacting the male detection terminals 97 are at the front surface end of the housing 10. Accordingly, the length of the male detection terminals 97 is substantially equal to the length of the adjacent male terminal fittings 92. As a result, common terminals can be used as the male detection terminals 97 and the adjacent male terminal fittings 92 so that production costs can be reduced. Further, the connector can be miniaturized by setting the contact positions close to the connection surface of the housing 10.

The support 52 and the press-in portions 55 are at the rear of the detection terminal 50, while the action portions 54 and the contacts 53 are at the front of the detection terminal 50. Thus, the entire detection terminal 50 is cantilevered forward with the rear end as a support. Thus, the structure of the detection terminal 50 is simplified as compared to the prior art and blank cutout is better. In other words, in the prior art, a fulcrum is provided near the front of a detection terminal and a large supporting area cannot be ensured. Thus, it has been necessary to provide backward extending press-in portions in addition to a resiliently deformable main portion folded back at the fulcrum. Accordingly, the structure of the prior art detection terminal has been complicated. However, the supporting area is concentrated near the rear of the detection terminal 50 utilizing a dead space in the rear part of the housing 10. Therefore, it is not necessary to fold the front of the detection terminal 50.

The pivoting portion 24 is lifted up in the partly connected state. The action portions 54 are caught and engaged with the pivoting portion 24, and the contacts 53 project substantially normal to the main portion 51 to contact the male detection terminals 97 from above. In other words, the action portions 54 are moved upon a displacement of the pivoting portions 24 and cause a corresponding displacement of the action portions 54. Thus, it is not necessary to provide a dedicated accommodation space for the detection terminal 50 in an area below the male detection terminals 97 in the mating housing 90, and the male detection terminals 97 can be set at lower positions. The bottom ends of the contacts 53 are aligned at substantially the same height as the contacts of the female detection terminals 95 adjacent in the housing 10, and the male detection terminals 97 also are aligned at substantially the same height as the contacts of the male terminal fittings 92 adjacent in the mating housing 90. Thus, unlike the prior art, the male detection terminals 97 are not provided above the male terminal fittings 92. Accordingly, the male detection terminals 97 are protected by the surrounding male terminal fittings 92, and the conventionally required ribs can be omitted. As a result, production cost can be further reduced.

The action portions 54 and contacts 53 overlap with respect to forward and backward directions FBD. Thus, moved amounts of the action portions 54 and contacts 53 displaced as the pivoting portion 24 makes a pivotal movement are substantially equal. Accordingly, unlike the prior art, it is not necessary to ensure that the action portions move more than the contacts 53 upon displacing the contacts 53. As a result, the moved amount of the pivoting portion 24 substantially corresponding to that of the action portions 54 can be made smaller than in the prior art, thereby eliminating the need to ensure a large deformation space for the pivoting portion 24 in the housing 10. Therefore, the height of the housing 10 can be reduced.

Each action portion 54 includes the base-end area 64 that is substantially continuous with the main portion 51 and the mount area 65 to be mounted on the pivoting portion 24. The mount area 65 is offset forward relative to the base-end area 64 and substantially aligns with the contact 53 with respect to forward and backward directions. Therefore, a degree of freedom in the shape of the contacts 53 can be improved.

The contacts 53 are exposed at the front of the housing 10, and unlike the prior art can be seen better from the front along the upper surface of the housing 10 in which the contacts are retracted from the front surface of the housing. Accordingly, the check on the height of the contacts 53 can be performed easily, and management cost can be suppressed.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The action portions are directly engageable with the pivoting portion in the foregoing embodiment. However, they may be engaged indirectly with the pivoting portion via intermediaries according to the invention.

The lock arm is seesaw-shaped in the foregoing embodiment. However, the lock arm may be a cantilever extending forward from the back end and the front thereof may be capable of making a pivotal displacement with the rear end as a support.

The press-in portions are provided in addition to the supports in the foregoing embodiment. However, they may be deleted and instead a member formed by cutting and bending similar to the support in the foregoing embodiment and adapted to restrict a backward movement of the detection terminal by projecting in a direction different to the projecting direction of the support according to the invention may be provided.

The contacts lie substantially completely within the formation areas of the action portions with respect to forward and backward directions in the foregoing embodiment. However, the action portions and contact portions may partly overlap with respect to forward and backward directions FBD.

What is claimed is:

1. A connector, comprising:

a housing with a front end to be connected with a mating housing, at least one lock arm formed on the housing, the lock arm having opposite front and rear ends, a pivoting portion in proximity to the front end of the lock arm and a support for pivotal movement of the lock arm rearward of the pivoting portion, an accommodating portion formed in the housing rearward of the front end of the lock arm; and a detection terminal with opposite front and rear ends, a support substantially at the rear end of the detection terminal supported at the accommodating portion of the housing, at least one action portion in proximity to the front end of the detection terminal and engaged with the pivoting portion of the lock arm so that displacement of the pivoting portion causes displacement of the action portion, and a contact disposed in proximity to the front end of the detection terminal and configured to contact a mating detection terminal of a mating housing when the housing and the mating housing are connected properly.

2. The connector of claim 1, wherein the action portion moves with the pivoting portion when the housing is partly connected so that a bottom end of the contact is aligned substantially at a common height as adjacent signal terminals in the housing.

3. The connector of claim 1, wherein the contact is exposed at the front of the housing.

4. The connector of claim 1, wherein the lock arm extends substantially in forward and backward directions.

5. The connector of claim 4, wherein the detection terminal extends substantially in the forward and backward directions.

6. The connector of claim 5, wherein the action portion and contact at least partly overlap with respect to the forward and backward directions.

7. The connector of claim 1, wherein the detection terminal includes a main portion with a plate surface that extends substantially along forward and backward directions, the action portion projecting at a first angle from the main portion and the contact projecting at a second angle from the main portion, the first and second angles being oriented so that action portion and the contact are in different planes.

8. The connector of claim 7, wherein the contact portion projects from one surface of the main portion and the action portion projects from a substantially opposite surface of the main portion.

9. The connector of claim 7, wherein the action portion includes a base-end area substantially continuous with the main portion and a mount area mounted on the pivoting portion.

10. The connector of claim 9, wherein the mount area is aligned substantially at the same position as the contact with respect to forward and backward directions and is offset forward relative to the base-end area.

11. A connector assembly, comprising:

a mating housing with a lock, a mating detection terminal mounted to the mating housing;

a housing to be connected with the mating housing, at least one resiliently deformable lock arm on the housing, the lock arm having opposite front and rear ends, a pivoting portion in proximity to the front end of the lock arm and a support for pivotal movement of the lock arm rearward of the pivoting portion, the lock of the mating housing engaging the pivoting portion of the lock arm and deforming the lock arm away from the mating detection terminal during connection of the housing with the mating housing, the lock arm resiliently returning towards the mating detection terminal and into engagement with the lock when the housing and the mating housing are connected properly, an accommodating portion formed in the housing rearward of the pivoting portion of the lock arm; and a detection terminal with opposite front and rear ends, a support substantially at the rear end of the detection terminal supported at the accommodating portion of the housing, at least one action portion in proximity to the front end of the detection terminal and engaged with the pivoting portion of the lock arm so that displacement of the pivoting portion displaces the action portion and a contact disposed for contacting the mating detection terminal of the mating housing in response to the resilient return of the lock arm when the housing is connected properly with the mating housing.

12. A connector assembly of claim 11 wherein the contact is exposed at the front end of the housing.

13. The connector assembly of claim 11, wherein the action portion and contact overlap at positions between the front and rear ends of the detection terminal.

14. The connector assembly of claim 11, wherein the detection terminal has a main portion extending substantially in forward and backward directions, the action portion and the contact projecting angularly from the main portion and being in different planes.

15. The connector assembly of claim 14, wherein the contact portion projects from one surface of the main portion and the action portion projects from a substantially opposite surface of the main portion.

16. The connector assembly of claim 15, wherein the action portion includes a base substantially continuous with the main portion and a mount panel mounted on the pivoting portion the mount panel being aligned substantially with the contact with respect to forward and backward directions and being offset forward relative to the base.

17. The connection assembly of claim 15, wherein the contact has a bent contact body aligned at a substantially common height position with adjacent signal terminals in the housing when the housing is partly connected with the mating housing.

18. A detection terminal comprising main body with opposite front and rear ends, a rear support substantially adjacent the rear end, of the main body, at least one front support at the front end of the main body, an action portion projecting angularly in a first direction from the front support and at least one contact projecting angularly in a second direction from the front support, whereby the rear support is configured to be supported on a housing, the action portion is configured to be engageable with a lock arm on the housing and the contact is configured for contacting a mating detection terminal of a mating housing.

19. The detection terminal of claim 18, wherein the action portion and the contact at least partly overlap with respect to forward and backward directions extending between the front and rear ends of the detection terminal.

20. The detection terminal of claim 19, wherein the contact and the action portion project in substantially opposite directions from the main body.

* * * * *